United States Patent [19]

Buck et al.

[11] Patent Number: 4,565,313

[45] Date of Patent: Jan. 21, 1986

[54] DRIVE-IN APPARATUS PARTICULARLY AN ELECTRIC TACKER FOR DRIVING IN FASTENERS

[75] Inventors: Manfred Buck, Nürtingen; Wolfgang Schmid, Filderstadt; Karl Wanner, Leinfelden-Echterdingen, all of Fed. Rep. of Germany

[73] Assignee: Robert Bosch GmbH, Stuttgart, Fed. Rep. of Germany

[21] Appl. No.: 684,909

[22] Filed: Dec. 21, 1984

[30] Foreign Application Priority Data

Feb. 18, 1984 [DE] Fed. Rep. of Germany ..... 3405906

[51] Int. Cl.[4] ..... B25C 5/15

[52] U.S. Cl. ..... 227/131; 173/117; 173/139

[58] Field of Search ..... 173/117, 139; 227/131, 227/130, 136

[56] References Cited

U.S. PATENT DOCUMENTS 3,438,449 4/1969 Smith ..... 173/139 X 4,515,303 5/1985 Schädlich et al. ..... 227/130 X

FOREIGN PATENT DOCUMENTS 3232137 6/1983 Fed. Rep. of Germany .

*Primary Examiner*—Paul A. Bell

*Attorney, Agent, or Firm*—Michael J. Striker

[57] ABSTRACT

In a drive-in apparatus for driving fasteners such as clips, nails, tacks, staples and the like in a workpiece, a solenoid for actuating impact blade which ejects the fastener is movably arranged in the apparatus housing. The solenoid includes an exciter coil formed with a central opening in which a cylindrical armature connected to the impact blade is magnetically accelerated in forward direction and returns to the starting position by a resetting spring. The exciter coil is also movably guided within the housing and spring biased in the forward direction by another biasing spring having a progressive elasticity characteristic. Depending on the steepness of the characteristic line of the second biasing spring, the backstrokes of the apparatus and the force necessary for tacking operation can be adjusted in broad range.

11 Claims, 1 Drawing Figure

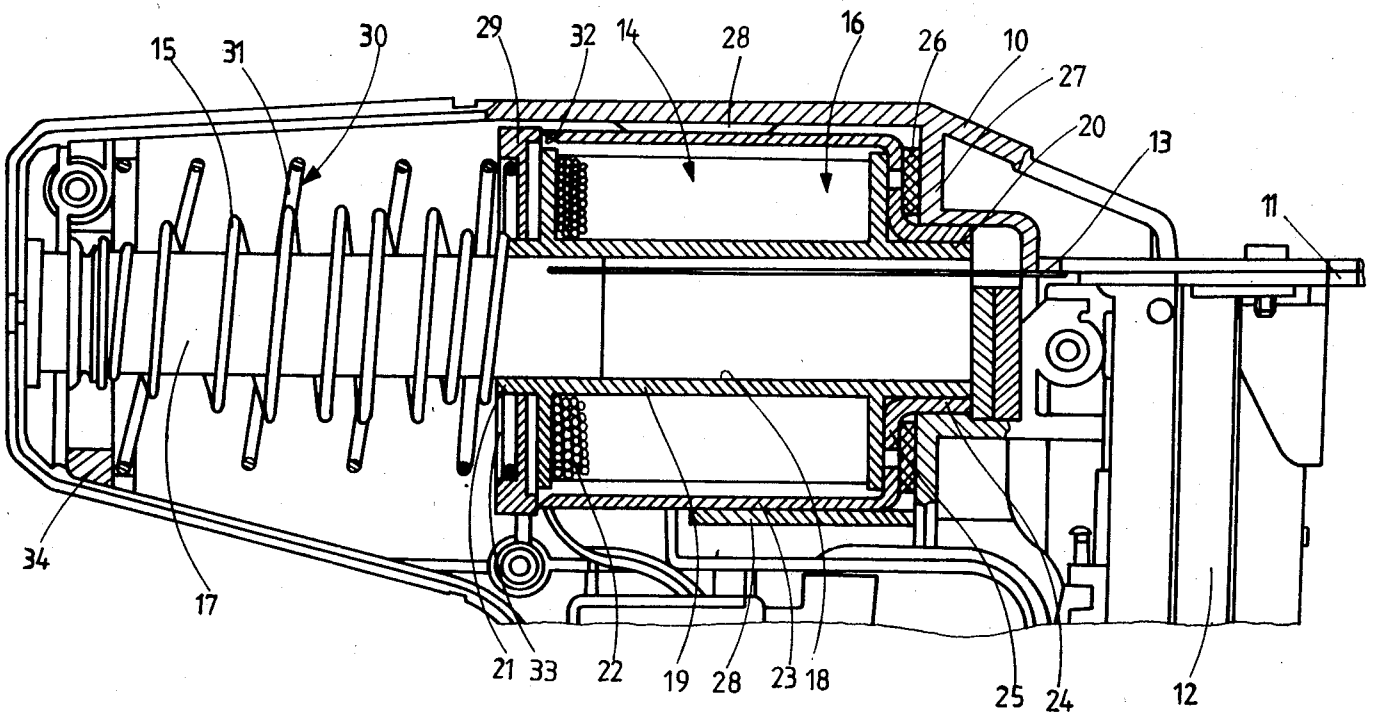
11
12
13
20
27
10
26
16
28
14
32
29
30
31
15
24
25
18
23
28
19
22
33
21
17
34

DRIVE-IN APPARATUS PARTICULARLY AN ELECTRIC TACKER FOR DRIVING IN FASTENERS

BACKGROUND OF THE INVENTION

The present invention relates in general to a drive-in apparatus for fasteners, such as clips, nails, tacks, staples and the like, and in particular to an electric tacker of the type having an impact blade guided in a housing for striking the fastener, and a solenoid including an exciter coil arranged in the housing and a reciprocating armature connected to the impact blade to activate the same.

In a prior art electric tacker of this kind, the exciter coil of the solenoid has a substantially reel shaped coil form supporting the windings, whereby both end faces of the coil form being secured to the tacker housing. Such known electric tackers operate in general with speeds of the impact blade or impact plunger amounting maximum to 9 meters per second. In order to drive in a clip at this speed, the impact blade must have a mass of about 150 grams. At an acceleration time of the impact blade of about 0.01 seconds, there results an average force of 135N exerted by the impact blade or impact plunger. When the time course of the excitation current corresponds to the time course of the latter force, a peak force of 190N results. Accordingly, the operator must press the electric tacker against a workpiece with at least this maximum force to insure that the electric tacker remains during the working process in contact with the workpiece. If the operator does not apply this required force then the fastener such as a clip or nail is not driven in flush with the workpiece on the one hand, and on the other hand, the tacker after cushioning the retractive movement is again accelerated forwards by the hand of the operator, and impacts against the workpiece. In the first case the fastener protrudes above the surface of the workpiece by a distance which depends on the actually applied force, while in the second case the recuperating ejector nose of the tacker in striking the surface of the workpiece causes ill-looking indentations. In both cases only very poor results of the tacking operation are obtained. Moreover, for the operator it is very unpleasant to work with a tacker which must be either pressed against the workpiece with an excessive force or otherwise considerable percussive shocks are generated.

SUMMARY OF THE INVENTION

It is therefore a general object of the present invention to overcome the aforementioned disadvantages.

More particularly, it is an object of the invention to provide an improved drive-in apparatus which generates only relatively minute backstroke force on the housing which can be taken up by the operator with play-like ease.

Another object of this invention is to provide such an improved drive-in apparatus which can be effortlessly kept in constant contact with the workpiece so that independently from the applied pressing force the fastener is always fully driven into the workpiece to be flush with its surface.

An additional object of this invention is to guarantee an optimum work result by securely eliminating any scratching or indentation in the surface of the workpiece due to the backstrokes.

In keeping with these objects and others which will become apparent hereinafter, one feature of the invention resides, in a drive-in apparatus of the abovedescribed kind, in the provision of a solenoid for actuating the impact blade of the apparatus, the solenoid including an exciter coil having a central opening and a reciprocating armature guided in the central opening and being connected to the impact blade, the exciter coil being movably arranged in the housing, and a biasing spring resting on the housing and urging the exciter coil into a rest position in the direction of forward movement of the armature.

The backward impulse imparted to the exciter coil during the forward acceleration of the impact blade accelerates the exciter coil in backward direction by about 1 meter per second. At the time point at which the fastener has been just fully driven into the workpiece, the exciter coil has covered a distance of about 10 mm backwards. During the first millimeters of this backward travel, the biasing spring counters the backward travel of the coil with a minute force only and accordingly an equally minute force is exerted on the housing of the apparatus so that the latter remains constantly in contact with the workpiece. The course of the backward motion of the exciter coil after the completion of the driving-in process is determined by progress of the characteristic line of elasticity of the biasing spring. A steeply progressive characteristic line of the spring saves installation space but at a reduced pressing force it permits back jumps of the drive-in apparatus. It is true that a small progressivity of the characteristic line of the biasing makes it necessary to employ a larger installation space but has the advantage of negligible backstrokes.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE illustrates in a partial longitudinal cross-section a drive-in apparatus of this invention in the form of an electric tacker for driving in fastening clips.

DESCRIPTION OF THE PREFERRED EMBODIMENT

The overall construction of the electric tacker shown by way of an example in this embodiment of the invention, is generally known from prior art and its construction and operation is described in detail for example in the German publication No. 3,232,137.

The electric tacker has a housing 10 formed with an ejector channel 11 into which fastening clips are successively fed from a magazine 12. The feeding mechanism for discharging individual fastening clips from the magazine into the ejector channel is also described in detail in the aforementioned German publication and for the purposes of this invention need not be further described. An impact plunger or impact blade 13 is guided in housing 10 in such a manner as to repeatedly project in the ejector channel 11 to strike a fastening clip present in the channel and to eject the clip into a workpiece onto which the ejector channel 11 is being pressed. To per-form this function, the impact blade 13 is driven by solenoid 14 against the force of a resetting spring 15.

The solenoid 14 includes an exciter coil 16 and an elongated armature 17 which is guided in a central opening 18 of the coil to move in two opposite directions along the axis of the coil. The exciter coil 16 consists of a coil body or form 19 having approximately a reel-like configuration and being provided at both ends thereof with cylindrical nipples 20 and 21. Coil windings 22 are wound between the end face of the coil 16 around the cylindrical central passage or opening 18. The end of the armature 17 which in the starting position remains in the central opening is connected to the impact blade 13 to move the same in axial direction of the coil. The coil form 19 is surrounded by a cup-shaped guiding sleeve 23 and its front cylindrical nipple 20 is inserted into a cylindrical socket 24 which is integral with the bottom 25 of the sleeve 23. The adjoining end side of the coil form 19 is connected to the inner surface of the bottom 25 by any suitable fastening means which also secures to the outer surface of the sleeve bottom 25 an annular elastic abutment 26. In de-energized condition of the solenoid 14, the bottom 25 of the guiding sleeve with the elastic abutment 26 rests on an annular step 27 of the housing 10.

The guiding sleeve 23 is slidably guided on ribs 28 which are arranged on the inner surface of housing 10 and distributed around the outer surface of the guiding sleeve. The open end side of the cup-shaped guiding sleeve 23 is closed by an annular disc 29 which constitutes an additional mass. Resetting means 30 which in this example are in the form of a helical spring 31 coaxially surrounding the resetting spring 15 of the armature 17, rests at one end on the housing 10 and presses with its other end against the annular disc 29 on the rim 32 of the guiding sleeve 23. The annular disc 29 is formed with a recess 33 which acts as a support and centering surface for the end of the helical compression spring 31. The opposite end of the helical biasing spring 31 rests on a damping element 34 which in this example is made as a rubber piece resting on the housing to function as a travel stop. The characteristic curve of elasticity of the helical pressure spring 31 is progressive. Depending on operational requirements, the elasticity characteristic curve can be either steep or flat and/or strongly or slightly progressive. Springs having steep elasticity characteristics require only a limited installation space, but the operator has to apply a relatively high pressing force in order to avoid backstrokes of the electric tacker. In the second case, when the spring has a flat characteristic line the installation space in the housing of the tacker must be made considerably larger but the advantage is an operation with minute backstrokes.

The operation of the abovedescribed electric tacker is as follows:

At the beginning of the drive-in operation, the outlet of the ejector channel 11 is put on the workpiece and the tacker is pressed against the latter. As described in the German publication No. 3,232,137, due to the applied pressure the frontmost of the fastening clips stored in series in the magazine 12 is advanced in the ejector channel 11. By a manual actuation of a non-illustrated switch in the power supply of the solenoid 14, electric current starts flowing through the winding 22 of the exciter coil. The armature 16 is drawn into the central opening 18 of the coil form whereby the impact blade 13 drives the fastening clip 13 from the ejector channel 11 into the workpiece. The retroactive impulse acting on the exciter coil 16 during the acceleration of the armature 17 imparts to the coil backward movement at a speed of about 1 meter per second. As a consequence, the exciter coil 16 at the time point at which the fastening clip has been just driven into the workpiece, has travelled a distance of about 10 mm backwards. Because of the progression of the characteristic of the helical biasing spring 31 the latter exerts during the first millimeters of its compression only a minute counteracting force on the exciter coil 16 which force can be effortlessly taken up by the operator. Accordingly, the electric tacker remains continuously in contact with the workpiece and the fastening clip is always completely driven into the workpiece, flush with its upper surface. After completion of the drive-in process of the fastening clip, the following course of motion of the exciter coil 16 is determined by the particular progression of the characteristic line of the biasing spring. A flat, slightly progressive characteristic line causes only a very minute backstroke on the housing 10 whereas as mentioned before, a steeper characteristic makes it necessary to apply a correspondingly higher pressure by the operator to avoid backstrokes.

It will be understood that each of the elements described above, or two or more together, may also find a useful application in other types of constructions differing from the types described above.

While the invention has been illustrated and described as embodied in an electric tacker, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A drive-in apparatus for driving fasteners such as clips, nails, tacks, staples and the like into a workpiece, comprising a housing, an impact member guided in the housing for ejecting a fastener, a solenoid including an exciter coil movably arranged in the housing and being formed with a central opening, an armature arranged for reciprocating movement in the central opening and being connected with the impact member, and a biasing spring resting at one end thereof on the housing and engaging the exciter coil to bias the same into a rest position in the direction of forward movement of the armature.

2. A drive-in apparatus as defined in claim 1, wherein the biasing spring has a progressive characteristic line of its elasticity.

3. A drive-in apparatus as defined in claim 1, wherein the biasing spring is a helical spring coaxially surrounding the armature and engaging at one end said housing and at the other end an end side of the exciter coil.

4. A drive-in apparatus as defined in claim 3, wherein a damping element acting as a limit stop is arranged between the one end of the helical spring and the housing.

5. A drive-in apparatus as defined in claim 1, wherein an additional mass is attached to said exciter coil.

6. A drive-in apparatus as defined in claim 1, wherein the exciter coil is arranged within a guiding sleeve which slidably engages inner surface portions of the housing.

7. A drive-in apparatus as defined in claim 6, wherein the guiding sleeve has a cup-shaped configuration having an annular bottom and a cylindrical nipple projecting in the forward direction from the cylindrical bottom, the exciter coil having a central cylindrical projection coaxial with the central opening and snugly fitting into the cylindrical nipple.

8. A drive-in apparatus as defined in claim 7, wherein the outer surface of the annular bottom of the guiding sleeve is provided with an elastic stop element which in de-energized condition of the solenoid rests on an annular step in the housing.

9. A drive-in apparatus as defined in claim 8, wherein the exciter coil includes a reel-shaped coil form attached to the inner surface of the annular bottom of the guiding sleeve.

10. A drive-in apparatus as defined in claim 9, wherein the coil form has a front end side attached to the inner surface of the annular bottom of the guiding sleeve, a rear end side in the range of the open side of the guiding sleeve, and cylindrical rear attachment projecting backwards from the rear end side, an additional mass in the form of an annular disc resting on the rear attachment and engaging the rim of the open side of the guiding sleeve, said biasing spring resting on said annular disc.

11. A drive-in apparatus as defined in claim 10, wherein annular disc is formed with an annular recess for accommodating and centering the biasing spring.

* * * * *